US008371951B2

(12) United States Patent
Nemeth et al.

(10) Patent No.: US 8,371,951 B2
(45) Date of Patent: Feb. 12, 2013

(54) RIDER-CONTROLLED SWING RIDE

(75) Inventors: Edward A. Nemeth, Hermosa Beach, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 310 days.

(21) Appl. No.: 12/966,160

(22) Filed: Dec. 13, 2010

(65) Prior Publication Data

US 2012/0149479 A1 Jun. 14, 2012

(51) Int. Cl.
*A63G 1/28* (2006.01)
*A63G 1/00* (2006.01)

(52) U.S. Cl. ..... 472/33; 472/39

(58) Field of Classification Search ..... 472/27, 472/29, 32–35, 39, 43–47
See application file for complete search history.

(56) References Cited

U.S. PATENT DOCUMENTS

| | | | | | |
|---|---|---|---|---|---|
| 916,680 | A | * | 3/1909 | Delmore | 472/32 |
| 2,307,737 | A | * | 1/1943 | Courtney | 472/34 |
| 2,364,699 | A | * | 12/1944 | Eastman | 472/33 |
| 2,436,014 | A | * | 2/1948 | Messier | 472/33 |
| 2,570,981 | A | * | 10/1951 | Psaila | 472/33 |
| 4,903,959 | A | * | 2/1990 | Barber | 472/3 |
| 4,973,042 | A | * | 11/1990 | Klopf et al. | 472/2 |
| 5,403,238 | A | | 4/1995 | Baxter et al. | |
| 5,453,053 | A | | 9/1995 | Danta et al. | |
| 5,820,469 | A | * | 10/1998 | Nobbs, Jr. | 472/33 |
| 6,060,847 | A | | 5/2000 | Hettema et al. | |
| 7,666,103 | B2 | * | 2/2010 | Pondorfer et al. | 472/33 |
| 2009/0209357 | A1 | | 8/2009 | Crawford et al. | |

* cited by examiner

*Primary Examiner* — Kien Nguyen
(74) *Attorney, Agent, or Firm* — Marsh Fischmann & Breyfogle, LLP; Kent A. Lembke

(57) ABSTRACT

A swing ride for providing lateral movement to a plurality of passenger vehicles. The ride includes a center hub rotating about its axis. The ride includes, for each of the passenger vehicles, a vehicle support assembly attached to rotate with the hub. The vehicle support assembly includes a flexible support member attached at a first end to the hub and at a second end to one of the vehicles. The vehicle support assembly includes a fulcrum assembly defining a fulcrum or pivot point for the support member between the first and second ends such that the member has a flexible and variable-length flexible arm attached to the vehicle. The fulcrum assembly is selectively positionable to move the fulcrum point in response to user input at the vehicle such that the passenger interactively moves the fulcrum point and thus moves the vehicle laterally inward and outward relative to the spinning hub.

20 Claims, 6 Drawing Sheets

RIDER-CONTROLLED SWING RIDE

BACKGROUND

1. Field of the Description

The present description relates, in general, to amusement park rides and other entertainment rides such as swing rides, and, more particularly, to swing-type round rides in which a rider or passenger of a vehicle (e.g., a simple chair to a passenger compartment adapted for receiving one, two, or more riders) is able to interactively control the ride experience including a lateral position of their vehicle relative to a hub and tangential velocity of the vehicle during rotation of the hub.

2. Relevant Background

Swing rides are types of amusement park rides in which a number of chairs (or "passenger compartment" or "vehicle") are attached to a central hub or structure. The chairs are each suspended by a fixed length of metal chains. During operation, the central hub is rotated or spun about its center axis. As the rotation rate of the hub increases, the Chairs are thrown outwards by centrifugal force. The rotation rate may be varied or altered during the ride to vary the radial position of the chairs and to vary the tangential velocity of the chairs. Also, in some cases, the hub may be tilted during the ride to provide additional variations in the motion of the chairs.

Amusement and theme parks are popular worldwide with hundreds of millions of people visiting the parks each year. Park operators continuously seek new designs for rides that attract and continue to entertain park visitors. While swing rides are popular for many park visitors, the lack of variety of the rides, including the fixed length of the support chain, causes each of these rides to provide essentially the same ride experience and limits repeat rides and certainly eliminates conventional swing rides as a ride that will attract more people to an amusement park. Furthermore, swing rides lack any form of interactive control over the ride experience with passengers literally simply being passively along for the predictably rotating ride.

There remains a need for new round rides including new swing rides that improve the ride experience. Such improved swing rides may be adapted to provide a larger range of ride dynamics, e.g., bigger range of vehicle speeds, centripetal acceleration, and lateral sliding/movement of the passenger, and the like, while retaining the benefits of a rotating structure or round ride including a small footprint, simple control systems, and relatively low construction and maintenance costs. Further, in some cases, these ride dynamics may be chosen or controlled by the swing ride passenger or rider rather than forcing them to accept a predefined motion of their chair or passenger vehicle/compartment.

SUMMARY

The present description teaches a new round ride or rotating hub ride that provides substantial amount of lateral movement of a passenger vehicle even at a single hub rotation rate. The rides are swing rides that use a flexible support member or linkage such as a chain or cable of a particular length to support the vehicle. To provide varying radial positions for the vehicle, a movable fulcrum mechanism is provided that may operate in response to signals from a ride controller or a passenger input device (e.g., a joystick, a steering wheel, or the like in the vehicle) to move a fulcrum or pivot point for the flexible linkage. In this manner, the vehicle has its flexible support arm (the portion of the flexible linkage extending between the fulcrum point and the anchor point on the vehicle) interactively varied by the passenger during rotation of the hub, and this causes changes in the lateral position of the vehicle and ride dynamics (e.g., a range of tangential velocities for a single hub rotation rate). The vehicle may be moved in and out during the ride, with the fulcrum point returning to a low position as the hub stops its rotation to facilitate loading/unloading.

More particularly, a swing ride for providing lateral movement to a plurality of passenger vehicles. The ride includes a drive assembly including a drive and a hub rotated, during operation of the drive, about a rotation axis. More importantly, the ride includes, for each of the passenger vehicles, a vehicle support assembly coupled with the drive assembly so as to rotate with the hub. The vehicle support assembly includes a flexible support member (e.g., a cable, a chain, or the like) attached at a first end to the huh and at a second end to one of the passenger vehicles. The vehicle support assembly further includes a fulcrum assembly defining a fulcrum or pivot point for the flexible support member between the first and second ends such that the member is divided into a first or inner portion and a second portion (i.e., a flexible support or pendulum arm). To provide the varying lateral positions of the vehicle or lateral movement, the fulcrum assembly is selectively positionable to move the fulcrum point such as in response to control signals from a ride controller or to manipulation of an input device in the vehicle (e.g., passenger may interactively move the fulcrum point to move the vehicle laterally inward and outward relative to the spinning hub). The moving of the fulcrum point causes the vehicle to move laterally toward and away from the hub.

The fulcrum assembly may include a vertical actuator that moves the fulcrum point along a vertical displacement path between a first location with a first height and a second location with a second height greater than the first height (e.g., the first height may be associated with load/unload position of the vehicle). Significantly, in such an embodiment, the vehicle has greater lateral movement than vertical movement as the fulcrum point is moved between the first and second locations. Further, in such an embodiment, the fulcrum assembly may include a pivotal guide member contacting the flexible support member at the fulcrum point, and the pivotal guide member (e.g., pulley or the like) may be moved by the vertical actuator along the vertical displacement path during rotation of the hub.

In other embodiments, the fulcrum assembly may include a rigid boom arm pivotally mounted at a first end to the hub that functions to support a pivotal guide member at a second end. The pivotal guide member may define the fulcrum point (with its contact point with the cable, chain, or other flexible support member). Further, the fulcrum assembly may include an actuator for selectively pivoting the boom arm through a predefined range of angular positions to move the fulcrum point. In this embodiment, the first end of the flexible support member may be attached to the hub at an anchor point with a greater radial distance from the rotation axis than the first end of the boom arm (e.g., to achieve significantly greater amounts of lateral or side-to-side motion of the vehicle than if anchored at a point that is in a vertical plane with the pivot end or point for the boom). The boom arm may be pivoted to sweep through an angle having an absolute value of at least about 45 degrees. In both of these embodiments, the fulcrum assembly may include an actuator operable in response to control signals from an input device in the vehicle to move the fulcrum point.

DETAILED DESCRIPTION

Figure 1:
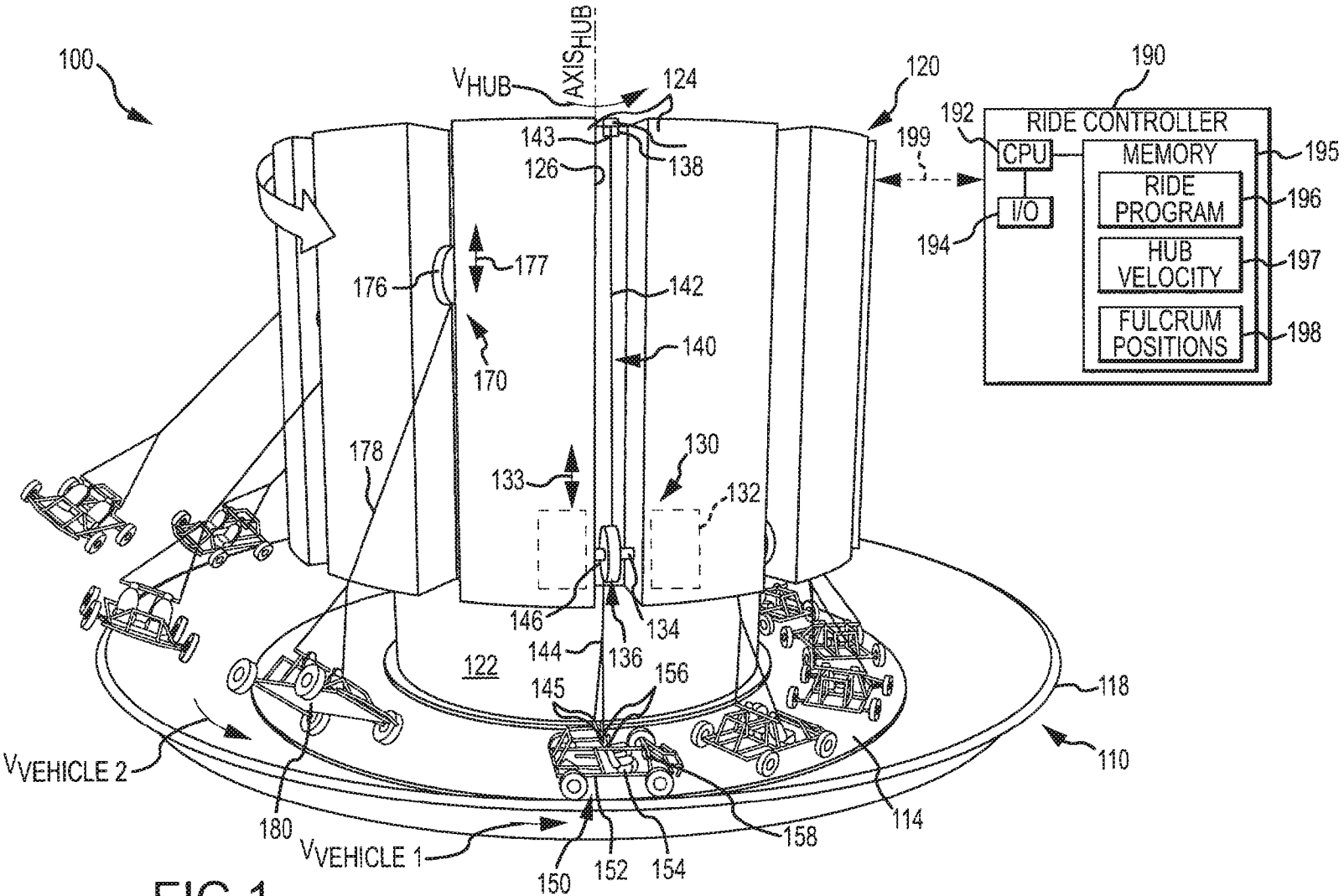
FIG. 1 is a perspective side view of a swing ride of an embodiment of the present description showing vehicle support assemblies interactively controlled by passengers or riders to achieve two differing vehicle positions and two differing ride dynamics (e.g., differing tangential velocity and centripetal accelerations)

The description is generally directed to an amusement park ride, which is called a swing ride or swing ride system in the following description, that provides a fun and exciting ride experience utilizing a simple rotating structure (e.g., a rotating central hub or center structure). One goal of designing the swing ride was to provide a new interactive ride experience that builds on the experience previously provided by chain-supported chair rides. The ride systems provide a number of vehicle support assemblies each supporting a passenger vehicle or compartment that includes a user input device such as a joystick, a steering wheel, a touch screen or the like. Each of these vehicle support assemblies includes a flexible support member (e.g., a length of cable, chain, or the like) that is affixed at a first end to the hub such as via an anchor assembly so as to rotate with the hub and is affixed at a second end to the vehicle.

Each of the support assemblies further includes a movable or positionable fulcrum assembly or mechanism, which is adapted to define a fulcrum or pivot point at a midpoint of the flexible support member based upon a passenger, rider, or control system input via the vehicle input device. In this manner, the rider or passenger is able to operate the movable fulcrum mechanism (e.g., a pulley contacting and supporting the cable or chain may be moved vertically up and down in a channel on a side of the hub) to move the fulcrum point so as to shorten or lengthen a variable length, flexible support arm that extend outward from the hub to the vehicle so as to vary their vehicle's radial position (and, in some cases, height) and ride dynamics (e.g., adjust tangential velocity for a particular hub rotation speed by changing the radius at which the vehicle rotates about the hub's center or rotation axis).

Prior to turning to the figures and specific examples, it may be useful to further generally describe ride systems proposed by the inventors. An exemplary ride system will include multiple vehicles each attached to a rotating center structure by a flexible linkage (e.g., a fixed length of cable, chain, or the like) through a movable fulcrum point. The fulcrum point may be moved by computer control to follow a specific predetermined show profile (e.g., based on a ride program or software application executed by a computer-based controller) and/or may be moved in response to rider/passenger control to match a desired outcome (e.g., a passenger may move a joystick in or out to decrease or increase their radial position). The vehicles are suspended above or support on (such as during loading/unloading and minimal radius positions) a circular deck or track surface, which may rotate with the hub, rotate independent from the hub, or be fixed in place (i.e., a stationary track that the vehicle ride on or over). The track surface may be banked to match the work space of the vehicle as its radius is increased.

As the center structure spins (e.g., in the range of 0 to 20 revolutions per minute (RPM) about its center axis), centripetal forces act on each vehicle and swing it out on a constant radius (for a particular hub rotation rate) about a particular fulcrum point. As the fulcrum point is moved away from the vehicle, the radius increases (e.g., the flexible support arm defined by the portion of the flexible linkage extending out from the fulcrum point) and causes the vehicle to swing further outward in a larger arc, thereby increasing the vehicle distance from the hub, increasing the vehicle's tangential velocity, and increasing side slip experienced by vehicle passengers.

The general experience is that of a traditional cable/swing ride, but, significantly, the ride systems described herein allow the rider and/or a ride control system to change the position of the vehicle relative to the hub by moving the location of the fulcrum point along the length of the flexible linkage. Unlike other rider-controlled rides (e.g., rigid arm round rides), the vehicle in the described swing rides is relatively free flying, and the swing rides may be configured to produce a mostly lateral movement of the vehicle (rather than mostly vertical). This type of lateral vehicle movement enables interesting and unique ride experiences through the changing ride dynamics considered alone and when such varying dynamics are combined with a terrain for the vehicle to fly over (which may be provided on the banked track).

Additionally, the swing rides may use interactivity to further enhance the experience by integrating reactive elements into the flyover terrain such as scoring targets and detectors triggering special effects based on vehicle radial locations such as lighting, smoke, water, projections, and other effects emanating from the track, the hub, or other portions of the ride or its environment. Examples of themed ride experiences include simulating flying, car jumping, surfing, sledding, skateboarding, snowboarding, and the like. Any of these simulated experiences may be combined with a gaming element in which the goal for scoring or initiating/triggering an effect is to fly over or avoid certain parts or elements of the flyover terrain on the flat or banked track surfaces or platform of the swing ride.

FIG. 1 illustrates a side perspective view of an embodiment of a swing ride system (or simply swing ride or swing race ride) 100. As shown, the swing ride 100 includes a base assembly 110 that may be supported upon the pound, a foundation, or the like, and the base assembly 110 includes an inner track 114 and an outer track 118. The inner track 114 may be a substantially planar disk through which a rotating huh 122 may extend (or a pedestal support for a rotating hub or center structure may extend through the disk-shaped track 114). The inner track 114 may coincide with a low point at which vehicles are supported in the swing ride 100 such that the track 114 may be considered the load/unload portion of the track or base assembly 110, and the vehicles may be supported and ride upon this track 114 or be supported a small distance above the track 114 surface to allow passengers to enter supported vehicles of the ride 100. The base assembly 110 also may include an outer track 118 that is sloped or banked such as at an angle of 15 to 60 degrees or the like such that a vehicle that is swinging laterally outward from (and later inward toward) the hub 122 may follow and fly just above the banked surface of the outer track 118 as it is vertically lifted upward at greater radial positions (and higher tangential velocities for particular hub rotation rates, $V_{Hub}$). As shown, though, the vehicles may fly outward past the track 118 at greater or maximum radii for the ride 100 so as to provide a free flying or jumping experience.

The swing ride 100 is a round ride in that it includes a center structure or hub assembly 120 with a hub 122 that spins or rotates about a central axis, $Axis_{Hub}$, at one or more velocities (e.g., operating rates from 0 to 20 RPM or the like). On the hub, support structures 124 defining a cable run or channel 126 are provided for each of a number of passenger vehicles or compartments (see vehicles 150 and 180, for example). As is explained below, the structure 124 may support a fulcrum positioning or movable fulcrum assembly 130, which in ride 100 may move up and down vertically to move the location of a fulcrum or pivot point 146 of a flexible linkage or support member 140.

Significantly, the swing ride 100 includes a number of vehicle support assemblies, and it may be useful to describe the vehicle support assembly used to support vehicle 150 in more detail. The vehicle support assembly includes a passenger vehicle 150 with a body 152 adapted with seats or other components 154 for receiving and securing one or more passengers 156 in the vehicle 150. The vehicle body 152 may take many forms with the example in system 100 being that of a race car that can "ride" on or above the surfaces of the inner and outer tracks 114, 118. The swing ride 100 may be interactive, and the vehicle 150 may include an input device 158 such as a joystick or a steering wheel (as shown) that a passenger 156 may manipulate or operate so as to select or vary the length of a flexible support arm 144 by changing the position of the fulcrum point 146 (e.g., by operating a movable fulcrum assembly 130 to move a pulley or other fulcrum point-defining element 136). The vehicle 150 is shown in a load/unload or minimal radial position for the vehicle 150 with a minimal or shortest length of the flexible support arm 144, which causes the vehicle 150 to ride on or just above the inner track 114 and allow the passengers 156 to load/unload the body 152 when the hub 122 is halted ($V_{Hub}$ is zero or nearly so).

In the vehicle support assembly, a flexible support member or linkage 140 is provided to support the vehicle 150 with a programmable and/or rider-selectable position of a fulcrum point 146, and the fulcrum point 146 is defined by a movable or positionable fulcrum assembly 130 (which may be operated in response to operation of input device 158 and/or control signals 199 from a ride controller 190 based on a ride program 196 or operator input). The flexible support member 140 may be a fixed length of cable(s), chain(s), or the like with a first or inner portion 142 that is affixed at an end 143 to an anchor 138 attached to the hub 122 such as to an upper portion of the cable channel/track 126 in support structure 124.

An opposite end 146 of the flexible support member 140 is attached to the vehicle body 152, and a pulley or other fulcrum point-defining component 136 contacts and supports the flexible support member 140 at a midpoint between the ends 143, 145 so as to define a fulcrum point 146 of the member 140 and to define a flexible support arm 144 extending outward from the hub 122 to the vehicle 150 and having a variable length to achieve a dynamic ride experience. For example, a passenger 156 may increase a length of the flexible support arm 144 by moving (as shown with arrow 133) the pulley 130 upward in channel 126 to move the fulcrum point 146 further away from the vehicle body 152, and this will allow the vehicle body 152 to swing radially further from the hub 122. As a result of this increasing radius or distance from the hub 122, the vehicle has an increased tangential velocity (such as $V_{Vehicle2}$ shown for vehicle 180) when compared with a tangential velocity, $V_{Vehicle1}$, achieved at the smaller unload/load radius of support arm 144 to a higher speed and cause the vehicle 150 to move laterally outward to ride up on or above the banked surface of track 118.

The movable fulcrum assembly 130 may include a motorized bogie or carriage that rides on tracks/cables in structure 124 to move a shaft or axle 134 vertically up and down 133. In this manner, the pulley 136 may be pivotally supported and, while remaining in contact with the flexible support member 140, change the location of the fulcrum point 146 to vary the length of the flexible support arm 144 (e.g., the outer portion of the flexible support member 140 as well as the inner portion 142). Hence, for the same hub rotation rate, $V_{Hub}$, about the center axis, $Axis_{Hub}$, of the hub or center structure 122, the vehicles of the ride 100 may be caused to move laterally inward and outward resulting in differing tangential velocities and to experience differing centripetal accelerations and other ride dynamics. As shown, the vehicle 150 is shown to be supported with a flexible support arm 144 of a minimal length while the vehicle 180 is shown to be supported with a much larger (and, in some embodiments, maximum) flexible support arm 178 in its flexible support member. In other words, the vehicle 180 travels at a greater radius relative to the hub axis, $Axis_{Hub}$, because its movable fulcrum assembly 170 has been operated to move 177 the pulley 176 (and the fulcrum point it defines) further up on the hub 122 and/or further away from the vehicle 180. This causes the vehicle 180 to have a tangential velocity, $V_{Vehicle2}$, that is significantly greater than the tangential velocity, $V_{Vehicle1}$, of the vehicle 150 with a much shorter support arm 144.

The operation of the swing ride 100 may be controlled by an onboard or remote ride controller 190 via wired or wireless control signals 199. These signals 199 may be used to control a drive used to rotate the hub 122 and also to move 133, 177 the movable fulcrum assemblies or mechanisms 130, 170 individually (e.g., lift or lower a fulcrum point in response to ride game elements such as a quick rise or drop when a score is achieved or when a vehicle 150, 180 passes over a desirable/undesirable theme element) and/or in a synchronized manner (e.g., to lower all to load/unload at the end of a ride, to move all to a particular vertical position during a portion of a ride, and so on). The ride controller 190 may be a computer-based system with a processor 192 managing operations of input/output devices 194 such as keyboards, a mouse, a touch screen, a monitor with a graphical user interface (GUI), and the like to allow an operator to view and input ride data (e.g., to view and set or adjust the hub rotation rate, $V_{Hub}$, to start a new ride cycle, to initiate a ride program or subroutine 195, or the like). The processor 192 may also manage storage and retrieval of ride data from memory/data storage 195, and, to control ride 100, to run or execute code/software in memory (computer readable code causing the computer 190 to perform particular functions). Specifically, the ride program 196 may be executed by CPU 192 to set a hub velocity 197 of the hub 122 with control signals 199 and/or to adjust fulcrum positions 198 with signals 199 used to operate one or more of the movable fulcrum assemblies 130, 170 during the spinning of center structure 122.

Figure 2:
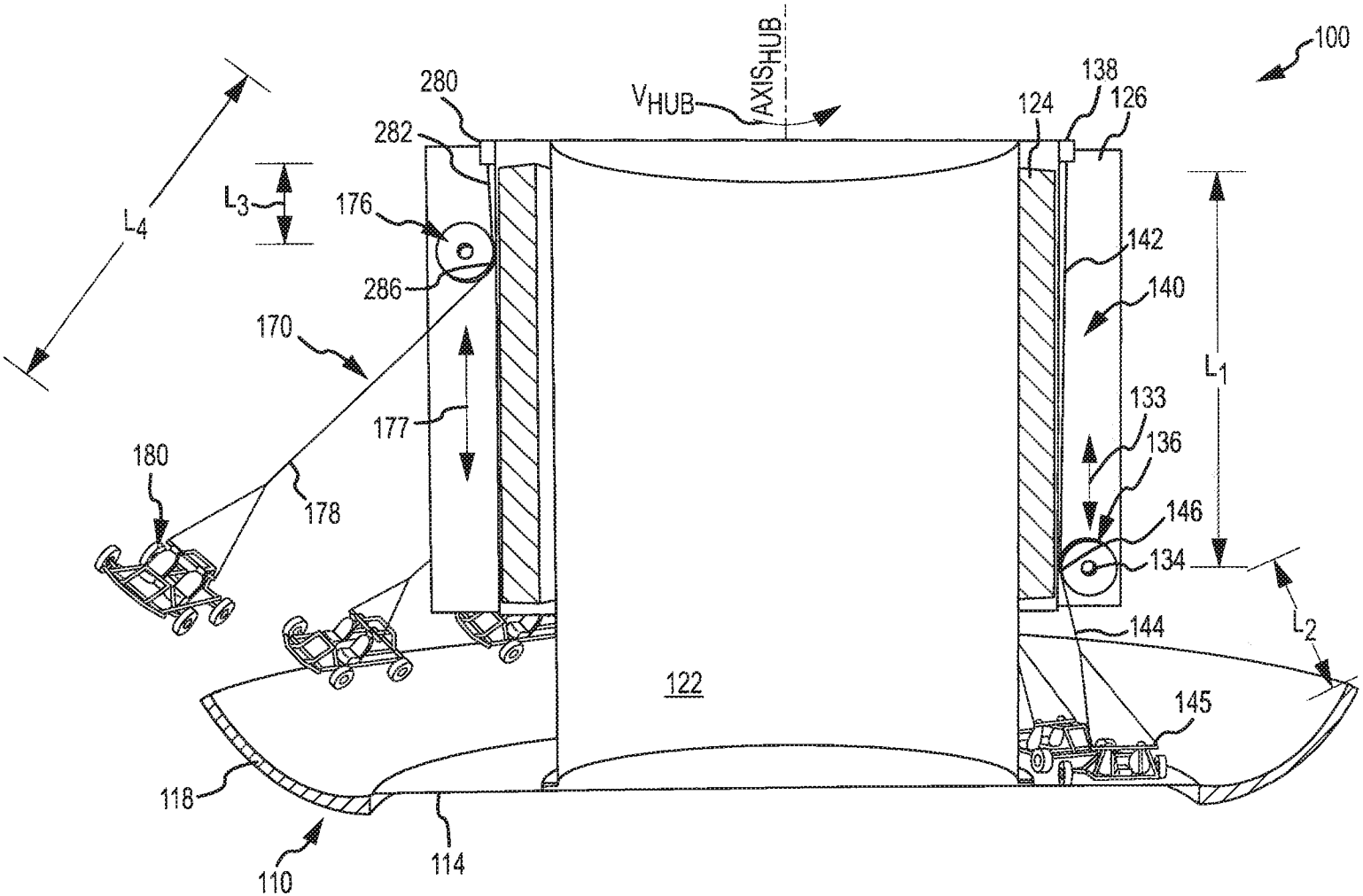
FIG. 2 is a cross sectional view of the swing ride of FIG. 1 illustrating in more detail the use of positionable (or "rider-positioned") fulcrum point mechanisms or assemblies to define a length of a flexible vehicle support arm extending out from the rotating or spinning hub and, thereby, to interactively vary ride dynamics for each vehicle in the swing ride.

FIG. 2 illustrates a cross sectional view of the swing ride 100. As shown, one vehicle support assembly is operated to place the vehicle 150 in a lower (or load/unload) and/or smaller lateral/radial position. The pulley 136 is in a lower (or even lowest) position in channel 126 on hub 122 such that the first or inner portion 142 of the flexible support member 140 has a relatively large length, $L_1$, relative to the length, $L_2$, of the flexible support arm or second/outer portion 144 of the flexible support member 140. In contrast, another vehicle support assembly is operated such that vehicle 180 is placed at a higher (or even maximum height) and/or greater lateral/radial position (e.g., at a maximum vehicle radius as measured from hub axis, $Axis_{Hub}$). The pulley 176 is moved 177 to be in a higher (or even highest) position in its support channel such that it is near the anchor 280, and the flexible member 170 has a first portion 282 that is relatively short as the fulcrum point 286 is distal to the vehicle 180 to provide a second portion or flexible support arm 178 that is relatively long (i.e., $L_3 \ll L_4$). This results in the vehicle 180 being laterally moved outward relative to the radial position of the vehicle 150 with a shorter support arm ($L_2 \ll L_4$ such that vehicle 150 has a smaller vehicle radius and corresponding smaller tangential velocity for a particular hub rotation rate, $V_{Hub}$).

In the swing race ride system (such as swing ride 100), the vehicles are each suspended from a fixed length, flexible support (e.g., a chain, a cable, or the like). An end of each flexible support is attached via an anchor to the hub such that each of the vehicles spins around a central axis with rotation of the hub or center support structure. Centripetal acceleration moves the vehicles away from the center structure where they are restrained at a vehicle radius or lateral position by an opposite end of the flexible support. The lateral movement is proportional in magnitude to the pendulum or flexible support arm length between the vehicle and the "constrained" or fulcrum point of the flexible support or linkage. By providing input devices in each vehicle, passengers or riders of the vehicles are able to control the location of the constrained or fulcrum point. The passenger-initiated movement of the fulcrum point (e.g., from a fulcrum low position to a fulcrum high position and vice versa) allows them to change or set the length of the pendulum or support arm and effectively move their vehicle radially inward and outward relative to the hub's center axis while the hub or center support structure is spinning (at a rotation rate that may be fixed or varied within a range by the ride controller based on a ride program).

As described, the vehicles are suspended by a fixed length support such as a cable or chain. The flexible support is constrained at a midpoint by a fulcrum point (defined by a position of a pulley or other component) that can be moved by the ride controller or passenger. Moving the fulcrum point changes the length of the pendulum or support arm above the vehicle. The longer the pendulum arm is the further from the center structure the vehicle will move when the system is spinning. This will, in effect, give the passenger (or ride controller) the ability to control lateral motion of the vehicle rather than only controlling up and down movement as in rigid support arm round rides. The passenger has the sense that they are steering the vehicle left and right on or over the surface of a track underneath the suspended vehicles. When the ride is completed, the fulcrum assembly is operated to return the fulcrum point to its lowest position, and the hub stops spinning to bring the vehicle back down to a load/unload position (e.g., even at this smallest pendulum length the vehicle will have an outward lateral movement when the hub is spinning but will settle inward to a minimum radius as the hub slows to a stop to facilitate loading and unloading).

In one non-limiting example, the drive and support assembly 120 of the ride 100 is configured in part with a hub rotation drive as for a typical round iron ride. Specifically, the assembly 120 may include one of the drive and support assemblies (e.g., modified to include the vehicle support assemblies described herein) designed and distributed by Zamperla Inc., 49 Fanny Road, Parsippany, N.J., USA or assemblies provided by other similar ride design and production companies such as Zierer or Bertazzon. Often, such an assembly 110 operates at relatively low speeds such as less than about 20 revolutions per minute (RPM), e.g., less than about 10 RPM such as about 6 RPM in some cases. In one embodiment, the hub 122 is rotated at rates that vary from about 6 RPM to a maximum rotation rate in the range of 10 to 20 RPM (or higher), which provides maximum lateral movement of vehicles to outer portions of vehicle workspaces at whichever pendulum or support arm length set or chosen by the ride controller 190 and/or vehicle passenger 156.

Figure 3:
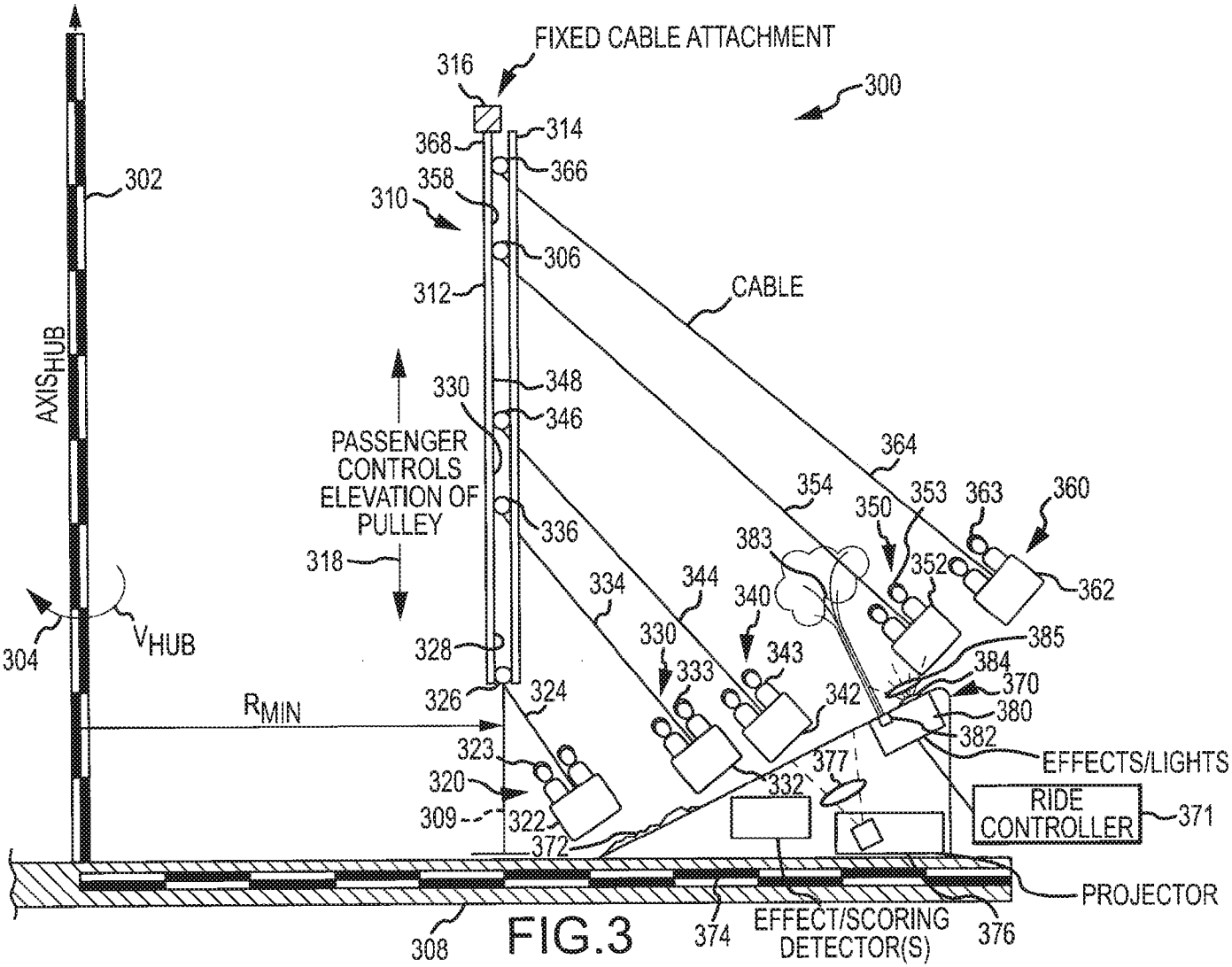
FIG. 3 is a schematic partial view of a swing ride of an embodiment showing movement of a pulley (e.g., a portion of a positionable fulcrum point mechanism) relative to an anchored end of a flexible linkage or vehicle support member to define a range of support arm lengths.
Figure 4:
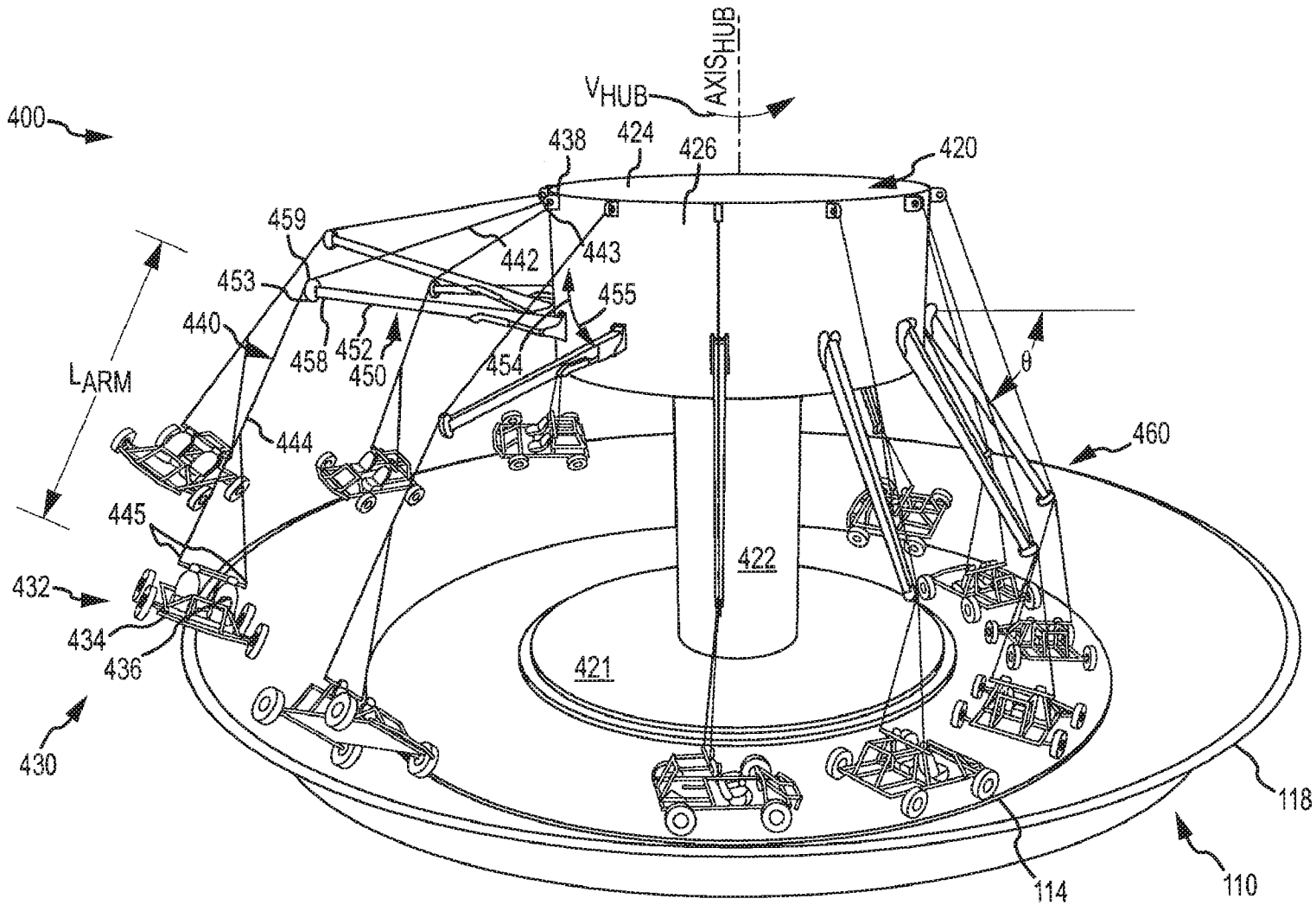
FIG. 4 is a perspective side view, similar to that of FIG. 1, showing another embodiment of a swing ride of the present description showing use of pivotal boom arms (or actuated arms) to reposition the pivot or fulcrum point of each flexible linkage supporting ride vehicles.

FIG. 3 illustrates a partial view of a swing ride 300 is provided to illustrate further use of a linear actuator to reposition a fulcrum point and move a vehicle laterally outward (and inward) along a banked/sloped track surface. In FIG. 3, a center structure or hub is not shown for simplicity of explanation only but it may take a form similar to that of found in assembly 120 of FIG. 1, and, also, only a subset of its vehicle support assemblies are shown as useful for showing various positions of vehicles that may be achieved with differing fulcrum point locations.

The ride 300 includes (for each vehicle/vehicle support assembly) a linear fulcrum positioning assembly 310 that would be mounted upon a hub to rotate 304 about a center axis, $Axis_{Hub}$, 302 at a hub rotation rate, $V_{Hub}$. The assembly 310 may include a pair of guides (e.g., guide rails or the like) 312, 314 that define a linear channel or travel path for movement or displacement 318 of a pulley or other fulcrum point-defining device (such as pulley 326 for vehicle support assembly 320). Further, an anchor (e.g., fixed cable attachment) 316 is provided to bind an inner end of each flexible support member to the hub of ride 300.

A first vehicle support assembly 320 is shown with its pulley 326 in a lowest or unload/load position. As a result, the vehicle 322 and its passengers 323 are placed at an initial or innermost lateral (and vertical) position at a particular hub rotation rate, $V_{Hub}$, and the vehicle 322 would drop down to a vertical position 309 for loading/unloading if the velocity, $V_{Hub}$, is or approaches zero with the vehicle 322 at a minimal radius, $R_{Min}$. At this operational state of assembly 320, the flexible support member provides a support or pendulum arm 324 that is relatively short (e.g., a minimum value for ride 300 associated with load/unload) as measured between the movable fulcrum point and an anchor point of the flexible support member and the vehicle. A first or inner portion 328 attached at its end to anchor 316 is relatively long (e.g., a maximum value for ride 300). In this state of assembly 320, the vehicle 322 is over or riding upon/over an inner portion of a themed surface 372 of a track 370, which may be sloped upward from the load/unload position of vehicle 322 (e.g., at an angle of 15 to 60 degrees or the like with 30 degrees being shown as one example of how a vehicle may move upward gradually with increasing lateral positions or vehicle radii). The angle between the pendulum arm 324 and vertical will vary with hub velocity, and other parameters (such as weight of vehicle 322 and passengers 323), but the lateral movement may range from 0 to about 45 degrees or more in some embodiments of ride 300.

Interestingly, the ride 300 includes a themed track assembly 370 that includes a themed surface 372 that may include objects or game components that encourage or guide the passengers 323 to "drive" their vehicle 322 to travel over differing portions of the surface 372 or even to fly outward off of or away from the surface 372. In this way, the passengers 323 may gain game points and/or trigger special effects and/or trigger differing ride control responses (e.g., the ride controller 371 may move the pulley 326 up or down in response to vehicle position relative to an object or detector 374 on track 370).

The track assembly 370 may include detectors 374 that sense presence/location of vehicles and provides data to ride controller 371. The ride controller 371 may track score for the passengers of a vehicle and/or may respond by initiating operation of various special effects. These effects may include a projector 376 that projects images 377 based on a ride program (e.g., to guide vehicles to move in or out relative to axis 302) and/or in response to detection of vehicles by detectors 374. Other effects 380 may be provided that can be controlled by ride controller 371 in response to detected positions of vehicles such as smoke/water or similar effects 382 placing material(s) 383 into the path of rotating vehicles or light assemblies 384 selectively providing light 385 in the path of or onto vehicles in ride 300.

The vehicle support assembly 330 is shown to be operated (by the passenger through an input device, for example) to move 318 a fulcrum point to a second position that is higher than the first position of assembly 320. As shown, the pulley 336 is moved upward 318 a distance (such as about a third of the length of guides 312, 314) that causes the fulcrum point to move higher on hub and further away from the vehicle 332 and its passengers 333. This causes the flexible support member to have a support or pendulum arm 334 that is longer but still shorter than a first or inner portion 338 extending vertically along guides 312, 314 to anchor 316. With the same hub velocity, $V_{Hub}$, but this longer pendulum arm 334, the vehicle 332 moves outward from the radial position of vehicle 322 and also upward a smaller amount (e.g., more lateral movement than vertical movement) so that the vehicle 332 is over a differing portion of themed surface 372 of track 370 (such as to fly over detectors 374).

Similarly, the vehicle support assemblies 340, 350 are operated to move 318 the fulcrum points of the vehicles 342, 352 further upward along guides 312, 314 and further away from vehicles 342, 352 and their passengers 343, 353. This increases the lengths of the pendulum or support arms 344, 354 relative to the inner or first portions 348, 358 attached to anchors 316 such that the vehicles 342, 352 move laterally further outward at a particular hub velocity, $V_{Hub}$, and upward to new heights along sloped/banked track surface 372. Finally, the vehicle support assembly 360 has its pulley 366 moved 318 to a maximum or highest point along guides 312, 314. This creates a longest or maximum length pendulum or support arm 364 for ride 300, which is much longer than the short inner or first portion 368 attached to anchor 316 and may be near to the overall length of the flexible support member or linkage of the vehicle support assembly 360. As a result, the vehicle 362 and passengers are at a maximum lateral position (greatest vehicle radius relative to hub axis 302) and a maximum vehicle vertical position or height for a particular hub velocity, $V_{Hub}$. Such a maximum lateral movement for a rotation rate may cause the vehicle 362 and its passengers 363 to appear to jump or fly off of the track surface 372 to give an enhanced feeling of free flying with a maximum tangential velocity for the ride 300 (at this hub rotation rate).

As will be appreciated, swing rides may implement a variety of movable position fulcrum mechanisms to practice the inventive idea of a ride controller or passenger set or positioned fulcrum or pivot point to define a length of a flexible support or pendulum arm. A vertical actuator (e.g., a device that moves the fulcrum point in a substantially vertical manner as shown in FIG. 3) provides relatively uniform linear motion along a diagonal slope (e.g., a trajectory for the vehicle that matches the banked but planar surface 372 of track 370 in swing ride 300).

The invention is not limited to the mechanisms shown in FIGS. 1-3, FIG. 4 illustrates another exemplary swing ride 400 that may be used to allow a vehicle to be moved laterally inward and outward relative a center hub axis, $Axis_{Hub}$. As with the ride 100, the swing ride 400 is shown to include a track assembly 110 with an inner track 114 and a banked/sloped outer track 118 extending outward from the inner track 114 (e.g., at an angle of 30 to 60 degrees or the like).

The swing ride 400 includes a rotating center structure 420 made up of a base or platform 421 in the center of inner track 114 and a central hub portion 422 that may be rotated or be stationary (e.g., simply support rotating portion 424 along with drive devices). The structure 420 further includes a rotating/spinning support wall or rim 424 with an outer surface 426 upon which are mounted portions of each vehicle support assembly to cause these assemblies and corresponding vehicles to rotate with the wall 414 at a particular hub velocity, $V_{Hub}$.

As shown, the swing ride 400 includes a plurality of vehicles supported within vehicle support assemblies that extend outward from rim/wall 424. For example, vehicle support assembly 430 is shown to be operated at a raised or non-loading/unloading position with pendulum/support arm length, $L_{Arm}$, that is greater than a minimum or load/unload length. The assembly 430 includes a vehicle 432 with a body 434 with seats for receiving/securing passengers. The assembly 430 further includes a flexible support member 440 with a first or inner portion 442 attached (e.g., rigidly or for pivoting) at an end 443 to an anchor 438, which is, in turn, attached to the surface 426 of wall/rim 424 to rotate with the center structure 420. The flexible support member or linkage 440 further includes a second/outer portion 444 defining a flexible support or pendulum arm between vehicle anchor points at ends 445 and a fulcrum/pivot point 459.

The vehicle support assembly 430 further includes a movable fulcrum assembly 450 that in the ride 400 takes the form of an actuated boom arm 452. The boom arm 452 may be a rigid member and be mounted at a first end 454 to the surface 426 of wall/rim 426 for selective pivoting or actuation 455 (e.g., in response to passenger input from a vehicle-mounted device and/or control signals from a ride controller (not shown in FIG. 4). Of course, the length of the boom arm 452 may vary to practice the ride 400, but, in some embodiments, the boom arm 452 has a length of 10 to 30 feet or more. The fulcrum point 459 is defined by a contact point on a pulley or similar contact component 458 on the distal or outer end 456 of the boom arm 452, and the fulcrum point 459 is moved through a semicircle or arc with a radius corresponding with the length of the arm 452 as the end 454 is pivoted 455 on wall surface 426.

As with rides 100 and 300, the movement of the fulcrum point 459 causes the length of the flexible support or pendulum arm 444 to be varied over a range between a minimum value and a maximum value, and this varying length, $L_{Arm}$, may cause varying ride dynamics for vehicle 432. For example, support assembly 460 is shown with its boom arm in a fully lowered position to provide a minimum arm length, $L_{Arm}$, and place the vehicle in a load/unload lateral position relative to inner track 114. In this position, the boom arm may be thought of as being at an angle, θ, relative to a horizontal plane passing through the inner end of the boom arm such as −30 to −60 degrees with an angle, θ, of about −45 degrees being shown, which shrinks the pendulum/support arm to a minimal value (as measured between the fulcrum point and the anchor points of the cable/chain on the vehicle). In contrast, the boom arm 452 may be at an angle, θ, in the range of about −45 to about +30 degrees or the like as the pivot/fulcrum point 459 is moved through an arc with pivoting 455 of boom end 454.

Figure 5:
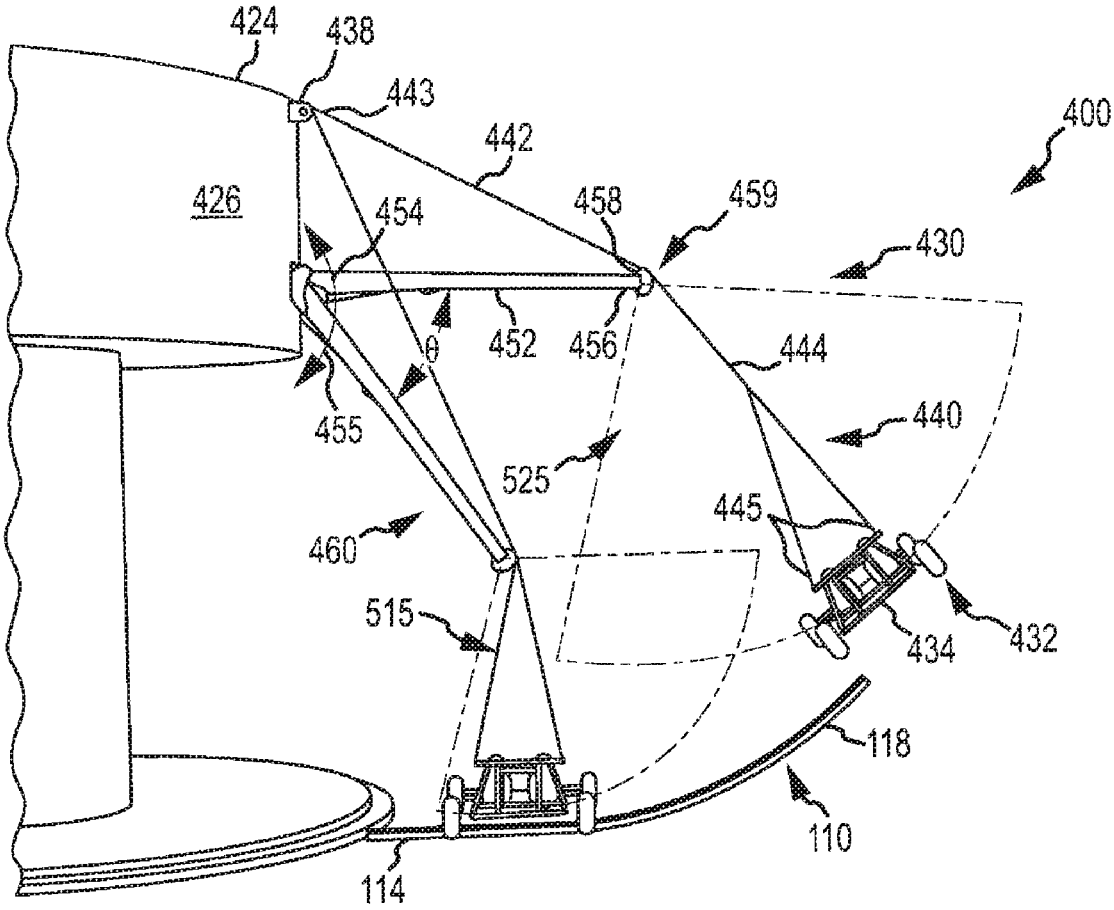
FIG. 5 is a partial side view of the swing ride of FIG. 4 illustrating the boom or actuated arms of two vehicle support assemblies in a load/unload position and in a fully raised position (for this embodiment) showing differing vehicle workspaces provided by each position of the arm.

FIG. 5 shows another view of the swing ride 400 showing the vehicle support assemblies 430 and 460 being used to position vehicles in two differing vehicle workspaces 515 and 525. As shown, the vehicle workspace 515 provided by the support assembly 460 that is operated to place the boom arm in a load/unload position has an overlap with a load/unload position (e.g., with the vehicle on or near the inner track 114). This may occur when the hub is not or is only minimally rotating. If the boom arm of assembly 460 is held in the load/unload position and the wall/rim 424 is rotated, the vehicle moves laterally outward away from the hub 422 to a new radial (and vertical) position within the workspace 515. As seen, the vehicle can only travel through an arc or semicircle as defined by the length, $L_{Arm}$, of the pendulum or flexible support arm in this lowest boom arm position (e.g., a relative small arc and workspace 515).

In contrast, the vehicle support assembly 430 is moved to position the boom arm 452 at least about coplanar with a horizontal plane passing the arm end 454. This moves the fulcrum point 459 away from the vehicle 432, which increases the length, $L_{Arm}$, of the flexible support or pendulum arm 444. The increase in this length, $L_{Arm}$, increases the size of the workspace 525 and the arc through which the vehicle 434 may be caused to travel by varying the hub velocity, $V_{Hub}$. In other words, workspaces 515, 525 are defined by a number of parameters including length of cable/chain 440, by the anchor point location of end 443 on the hub structure 420, and the position of the fulcrum/pivot point 459 (which may be varied during spinning of hub structure 420 through the pivoting 455 of arm 452 and by choosing the length of the boom arm 452, which may be varied during spinning in some embodiments such as with a telescoping boom arm 452 to move end 456 further from or closer toward inner or first end 454).

Figure 6:
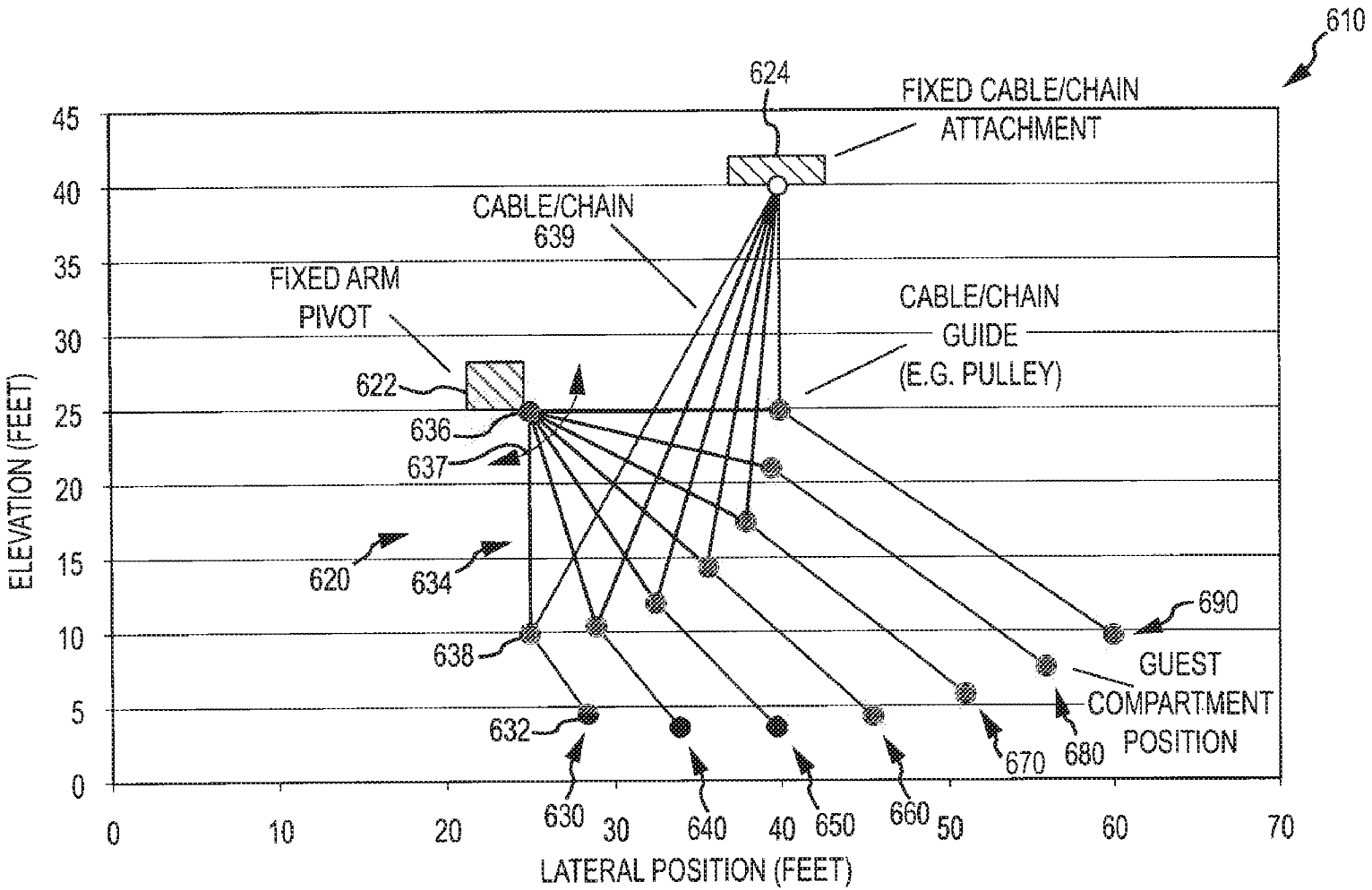
FIG. 6 illustrates another embodiment of a swing ride shown in schematic or graphical form showing differing lateral positions achieved with movement or rotation of a boom or actuated arm through a number of positions and showing use of an offset (relative to the arm pivot point) anchor for the flexible linkage or vehicle support member.

In ride 400, the anchor point or fixed attachment 438 for the end of the flexible linkage 440 is generally positioned to be in the plane of or coplanar with the pivot point or end 454 of the boom arm 452. However, it may be desirable to change the anchor location of the first/inner end of the flexible linkage so as to change the trajectory or path that the vehicle may following during movement of the fulcrum point (e.g., pivoting of the boom arm). FIG. 6 illustrates with a graph 610 showing a number of operating states or fulcrum positions 630, 640, 650, 660, 670, 680, 690 for a swing ride that includes a rigid support or boom arm 534 with a pivot end 536 and an outer end 638 providing a cable/chain guide (e.g., a pulley) that defines a fulcrum point for a vehicle's flexible support member 639. The arm 634 is selectively pivoted or positioned by pivot mechanism 622 as shown with arrow 637 to move the outer end 638 and fulcrum point through an arc defined by the length of the arm 634. The fixed length flexible linkage 639 is coupled at a first or inner end to an anchor or fixed attachment and to the hub (e.g., to rotate with the center hub structure).

The graph 610 compares vehicle anchor point 632 elevation (on the Y-axis) with lateral position (on the X-axis) of the vehicle anchor point 632. As shown, the fixed cable/chain attachment 624 (or flexible linkage anchor point to the hub) has been moved radially away or outward from the arm rotation point 636 (e.g., to not both be on a vertical plane such as a vertical wall of the hub structure). As shown, moving the anchor point 624 radially away from the arm rotation point 636 gives a significant amount of lateral or side-to-side motion relative to the axis of the hub (e.g., the zero lateral position in graph 610). In this example, the arm. 634 has a length of about 15 feet and is moved through an angular rotation of about 90 degrees, and, with the length of cable/chain shown, this results in lateral movement of over 30 feet (e.g., twice that provided by the boom arm 634 itself) while only providing vertical movement of about 5 to 8 feet such that lateral movement is the most noticeable movement to vehicle passengers.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. A variety of vehicle trajectories may be implemented with the basic swing ride features described herein. The configurations described were generally chosen so as to produce more lateral movement than vertical movement of the passenger vehicles or compartments, but it may be useful to provide more vertical movement and smaller amounts of lateral movement with the moving fulcrum point concept taught by this description. The shape of the vehicle trajectory (e.g., as may be thought of as a shape traced by a number of vehicle positions at differing fulcrum point locations) generally may be defined by: selecting a spatial relationship between the fixed cable/chain attachment or anchor location on the hub; setting linear movement of a fulcrum point positioning mechanism, pivoting of a fixed boom arm through a particular angular range, and the like; and defining a path for moving the fulcrum point (e.g., a channel/track for moving a pulley, selecting a boom arm length, and so on).

We claim:

1. A swing ride for providing lateral movement to a plurality of passenger vehicles, comprising:

a drive assembly including a drive and a hub rotated, during operation of the drive, about a rotation axis; and for each of the passenger vehicles, a vehicle support assembly coupled with the drive assembly to rotate with the hub, wherein the vehicle support assembly includes a flexible support member attached at a first end to the hub and at a second end to one of the passenger vehicles and wherein the vehicle support assembly further includes a fulcrum assembly defining a fulcrum point for the flexible support member between the first and second ends, the fulcrum assembly being selectively positionable to move the fulcrum point.

2. The swing ride of claim 1, wherein the flexible support member comprises a fixed length of cable, rope, or chain extending between the first and second ends and providing, for the vehicle, a flexible support arm of varying length, as measured between the fulcrum point and the second end, whereby by the vehicle swings laterally toward and away from the hub with movement of the fulcrum point.

3. The swing ride of claim 1, wherein the fulcrum assembly comprises a vertical actuator moving the fulcrum point along a vertical displacement path between a first location with a first height and a second location with a second height greater than the first height and wherein the vehicle has greater lateral movement than vertical movement as the fulcrum point is moved between the first and second locations.

4. The swing ride of claim 3, wherein the fulcrum assembly comprises a pivotal guide member contacting the flexible support member at the fulcrum point and wherein the pivotal guide member is moved by the vertical actuator along the vertical displacement path during rotation of the hub.

5. The swing ride of claim 1, wherein the fulcrum assembly comprises a rigid boom arm pivotally mounted at a first end to the hub and supporting a pivotal guide member at a second end defining the fulcrum point and wherein the fulcrum assembly includes an actuator for selectively pivoting the boom arm through a predefined range of angular positions to move the fulcrum point.

6. The swing ride of claim 5, wherein the first end of the flexible support member is attached to the hub at an anchor point with a greater radial distance from the rotation axis than the first end of the boom arm.

7. The swing ride of claim 5, wherein the boom arm is pivoted to sweep through an angle having an absolute value of at least about 45 degrees.

8. The swing ride of claim 1, wherein the fulcrum assembly includes an actuator operable in response to control signals from an input device in the vehicle to move the fulcrum point.

9. A swing race ride system, comprising:

a central hub with a drive rotating the hub about a central axis at a rotation rate;

a passenger vehicle with an input device operable by a passenger; and a vehicle support assembly comprising a flexible linkage attached at a first end to an anchor on the hub and at a second end to the passenger vehicle, wherein the vehicle support assembly further includes a movable fulcrum mechanism operating in response to manipulation by the passenger of the input device to move a fulcrum point on the flexible linkage from a first to a second location.

10. The system of claim 9, wherein a portion of the flexible linkage between the fulcrum point and the second end of the flexible linkage increases in length during the movement of the fulcrum point from the first to the second location allowing the passenger vehicle to move further radially away from the hub to have a greater tangential velocity at the rotation rate.

11. The system of claim 9, further comprising a track assembly with a sloped track surface extending about the central axis and positioned beneath and spaced apart from the vehicle with the fulcrum point at the first and second locations, the sloped track surface being angled upward with increasing radial distance from the central axis at an angle of at least about 15 degrees.

12. The system of claim 11, wherein the track assembly further includes detectors detecting location of the passenger vehicle and effect components responding to signals from the detectors to initiate an effect.

13. The system of claim 9, wherein the movable fulcrum mechanism comprises a pulley defining the fulcrum point with a surface contacting the flexible linkage between the first and second ends and wherein the movable fulcrum mechanism includes a linear actuator moving the pulley vertically to move the fulcrum point between the first and second locations.

14. The system of claim 9, wherein the movable fulcrum mechanism includes a rigid boom arm pivotally supported at a first end upon the hub, wherein the rigid boom arm supports a guide that contacts the flexible linkage at a second end, wherein the movable fulcrum mechanism further includes an actuator that rotates, in response to operation of the input device, to pivot the first end of the boom arm to reposition the second end, and further wherein the anchor on the hub for the first end of the flexible linkage is spaced apart a distance from the first end of the boom arm.

15. An amusement park ride, comprising:

a drive assembly including a hub rotatable about a central axis;

a flexible support arm with a first length and a second length greater than the first length;

a passenger vehicle on an end of each of the support arms, wherein the first and second length are measured between a pivot point coupled to the hub and an end of the support arm attached to the passenger vehicle; and for each of the support arms, a mechanism for moving the pivot point to vary the lengths of the support arms between the first and second lengths.

16. The ride of claim 15, wherein the flexible support arm is a portion of a flexible linkage extending outward from the pivot point and wherein the flexible linkage has a fixed length and has an end, opposite the end attached to the passenger vehicle, that is attached to an anchor on the hub.

17. The ride of claim 16, wherein the mechanism includes a boom with a first end pivotally supported upon the hub and a second end supporting a guide member contacting the flexible support arm at the pivot point and wherein the mechanism further includes an actuator operating to pivot the first end of the boom to move the pivot point from a first location to a second location corresponding with the first and second lengths for the support arm, respectively.

18. The ride of claim 16, wherein the mechanism includes a vertical actuator, which is coupled with the hub, that includes a pivotal guide member abutting the flexible support at the pivot point and wherein the vertical actuator operates to move the pivotal guide member from one location having a first height to a second location having a second height greater than the first height.

19. The ride of claim 15, wherein the vehicle includes a user input device operable by a passenger to control the mechanism to move the pivot point to a plurality of positions between a first location and a second location.

20. The ride of claim 15, further comprising a ride controller executing a ride program defining a plurality of positions for the pivot point, wherein the ride controller transmits control signals to the mechanism to move the pivot point to a set of the defined pivot point positions for at least a portion of the vehicles.

* * * * *